US009293846B2

(12) United States Patent
Komoto et al.

(10) Patent No.: US 9,293,846 B2
(45) Date of Patent: Mar. 22, 2016

(54) THIN CONNECTOR HAVING A FIRST CONNECTOR SLIDABLY SUPERIMPOSED ON A SECOND CONNECTOR

(71) Applicant: Japan Aviation Electronics Industry, Limited, Tokyo (JP)

(72) Inventors: Tetsuya Komoto, Tokyo (JP); Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/539,743

(22) Filed: Nov. 12, 2014

(65) Prior Publication Data

US 2015/0171532 A1 Jun. 18, 2015

(30) Foreign Application Priority Data

Dec. 12, 2013 (JP) ..... 2013-256809

(51) Int. Cl.
*H01R 12/71* (2011.01)
*H01R 13/24* (2006.01)

(52) U.S. Cl.
CPC ..... *H01R 12/716* (2013.01); *H01R 13/2442* (2013.01)

(58) Field of Classification Search
CPC .. H01R 12/712; H01R 12/714; H01R 12/716; H01R 12/718
USPC ..... 439/670, 629
See application file for complete search history.

(56) References Cited

U.S. PATENT DOCUMENTS 5,395,250 A * 3/1995 Englert, Jr. ..... H01R 12/716 439/65
2012/0270446 A1* 10/2012 Shibata ..... H01R 12/716 439/629
2014/0004752 A1* 1/2014 Sagayama ..... H01R 12/89 439/670
2014/0162679 A1* 6/2014 Harel ..... H04W 16/28 455/452.2

FOREIGN PATENT DOCUMENTS

JP 2012-226977 11/2012

* cited by examiner

*Primary Examiner* — Chandrika Prasad
(74) *Attorney, Agent, or Firm* — Muncy, Geissler, Olds & Lowe, P.C.

(57) ABSTRACT

A thin connector comprises a first connector having a flat plate shape and a second connector having a flat plate shape superimposed on and fitted with each other, the first connector including first contacts arrayed in a direction, each first contact being provided with a first contact portion, the second connector including second contacts arrayed in a same direction as the direction in which the first contacts are arrayed, each second contact being provided with a second contact portion, each first contact having a spring portion which extends in a direction obliquely crossing the direction in which the first contacts are arrayed and on which the first contact portion is formed.

14 Claims, 16 Drawing Sheets

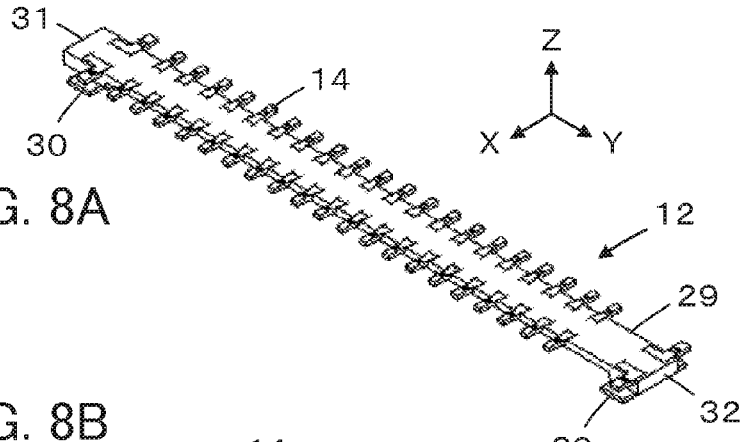
FIG. 8A
FIG. 8B
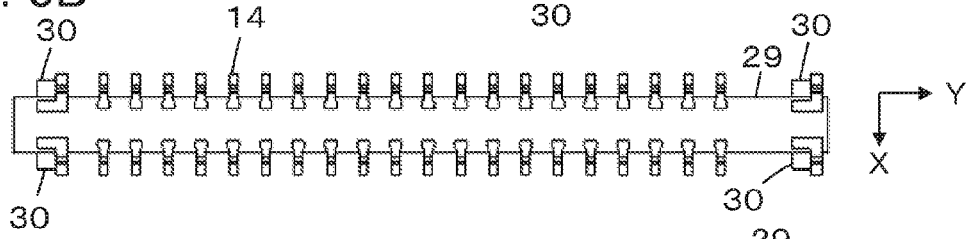
FIG. 8C
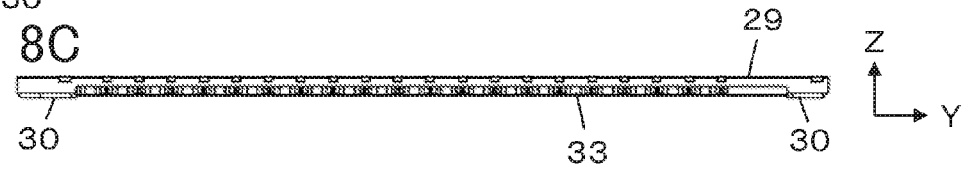
FIG. 8D
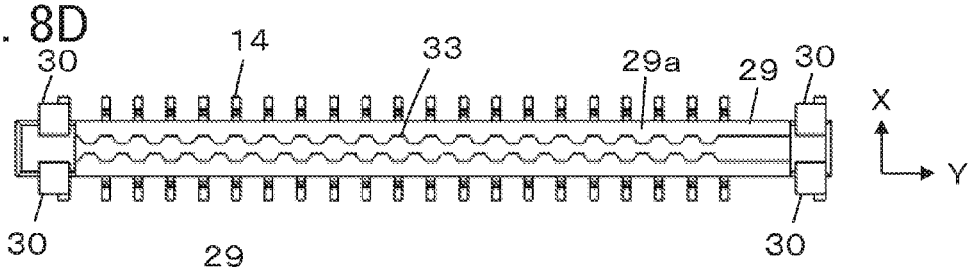
FIG. 8E
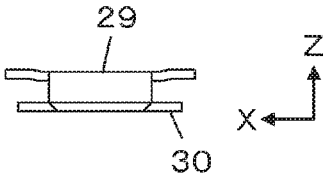
FIG. 9A
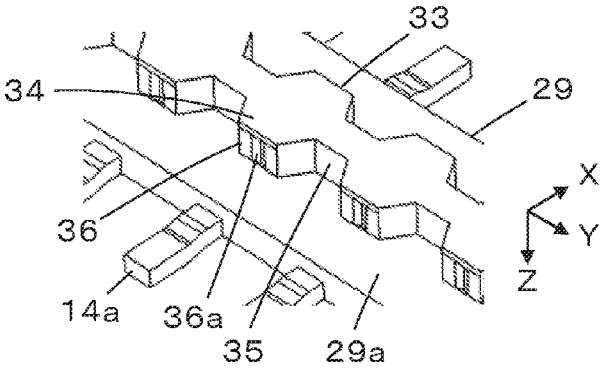
FIG. 9B
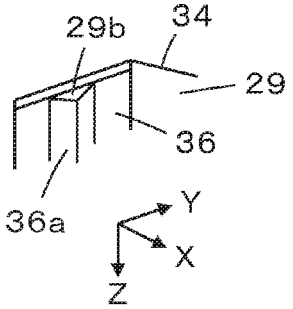

THIN CONNECTOR HAVING A FIRST CONNECTOR SLIDABLY SUPERIMPOSED ON A SECOND CONNECTOR

BACKGROUND OF THE INVENTION

The present invention relates to a thin connector, in particular, to a substrate-to-substrate connector comprising a first connector having a flat plate shape and a second connector having a flat plate shape superimposed on and fitted with each other in a fitting plane.

As a connector of this type, for example, JP 2012-226977 A discloses a connector as illustrated in FIG. 31. The connector comprises a receptacle 2 mounted on a first substrate 1 and a plug 4 (not shown) mounted on a second substrate 3. In the receptacle 2, a plurality of receptacle contacts 5 having spring characteristics are formed to be arrayed as illustrated in FIG. 32, and in the plug 4, protruding plug contacts 6 are formed to be arrayed as illustrated in FIG. 33.

Each of the receptacle contacts 5 has a main arm portion 5*a* curved so as to form inside thereof an opening portion S, an auxiliary arm portion 5*b* provided so as to face the main arm portion 5*a*, and a projection portion 5*c* provided in the vicinity of the tip end of the main arm portion 5*a* and the tip end of the auxiliary arm portion 5*b*, as illustrated in FIG. 34. The opening portion S is to receive the plug contact 6.

As illustrated in FIG. 35, upon superimposing the plug 4 on the receptacle 2, the protruding plug contacts 6 of the plug 4 are inserted into the opening portions S of the corresponding receptacle contacts 5, and in this state, the plug 4 mounted on the second substrate 3 is slid in the direction of the arrow C with respect to the receptacle 2 mounted on the first substrate 1 as illustrated in FIG. 36, whereby each of the protruding plug contacts 6 of the plug 4 moves as having its side surface kept in contact with the main arm portion 5*a* over the whole length thereof and is elastically caught among the tip end of the main arm portion 5*a*, the tip end of the auxiliary arm portion 5*b* and the projection portion 5*c*. Thus, the receptacle 2 and the plug 4 are fitted with each other, and the receptacle contacts 5 and the plug contacts 6 are electrically connected in this manner.

However, as illustrated in FIG. 36, the connector has a structure in which the plug 4 mounted on the second substrate 3 is slid relatively to the receptacle 2 mounted on the first substrate in the direction of an arrow C orthogonal to the arrangement direction of the receptacle contacts 5 and the plug contacts 6 to be thereby fitted to the receptacle 2. Hence, there is a problem that the connector inevitably has a long length in the direction orthogonal to the arrangement direction of the receptacle contacts 5 and the plug contacts 6.

SUMMARY OF THE INVENTION

The present invention has been made in order to solve the conventional problem described above and is aimed at providing a thin connector whose length in the direction orthogonal to the arrangement direction of a plurality of contacts can be reduced.

A thin connector according to the present invention comprises a first connector having a flat plate shape and a second connector having a flat plate shape superimposed on and fitted with each other in a fitting plane, wherein the first connector includes a plurality of first contacts arrayed in a direction, each of the plurality of first contacts being provided with a first. contact portion, wherein the second connector includes a plurality of second contacts arrayed in a same direction as the direction in which the plurality of first contacts are arrayed, each of the plurality of second contacts being provided with a second contact portion, wherein each of the plurality of first contacts has a spring portion which extends in a direction obliquely crossing the direction in which the plurality of first contacts are arrayed and on which the first contact portion is formed, and wherein the first connector and the second connector are superimposed on each other in the fitting plane and are slid relatively in the direction in which the plurality of first contacts and the plurality of second contacts are arrayed so that the second contact portion of each of the plurality of second contacts in the second connector comes in contact with the first contact portion of a corresponding first contact among the plurality of first contacts in the first connector, whereby the first connector and the second connector are fitted with each other.

BRIEF DESCRIPTION OF THE DRAWINGS

FIGS. 8A-8E are a perspective view when viewed obliquely from above, a plan view, a front view, a bottom view, and a side view, respectively, illustrating the plug used in the thin connector according to Embodiment 1.

FIGS. 9A and 9B are an enlarged partial perspective view of a plug contact when viewed obliquely from below and an enlarged perspective view of a plug contact portion of the plug contact, respectively.

DETAILED DESCRIPTION OF THE INVENTION

Embodiments of the present invention will be described below based on the appended drawings.

Embodiment 1

Figure 1:
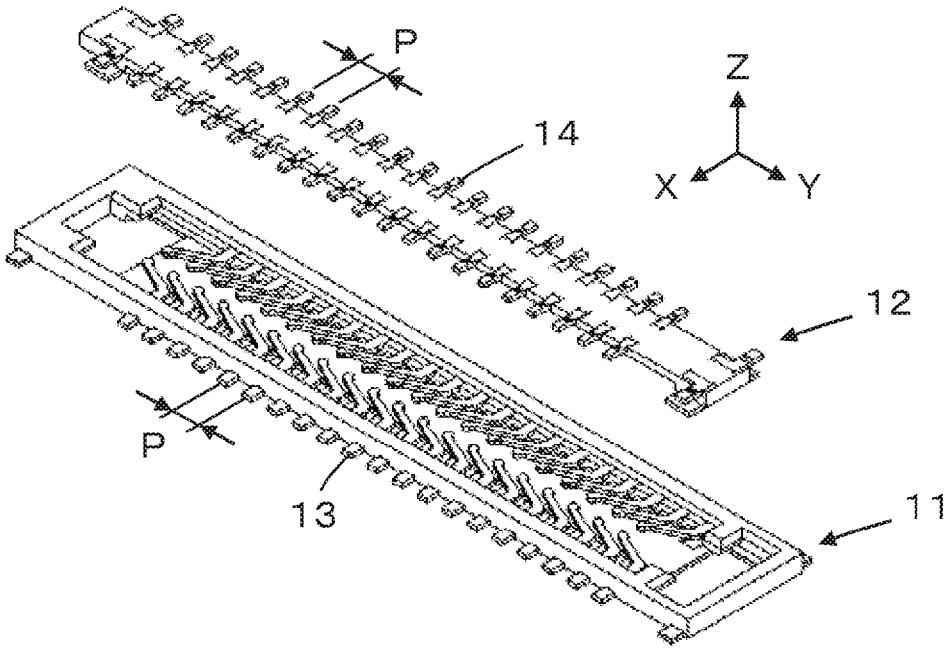
FIG. 1 is a perspective view of a receptacle and a plug of a thin connector, when viewed obliquely from above, according to Embodiment 1 of the present invention.
Figure 2:
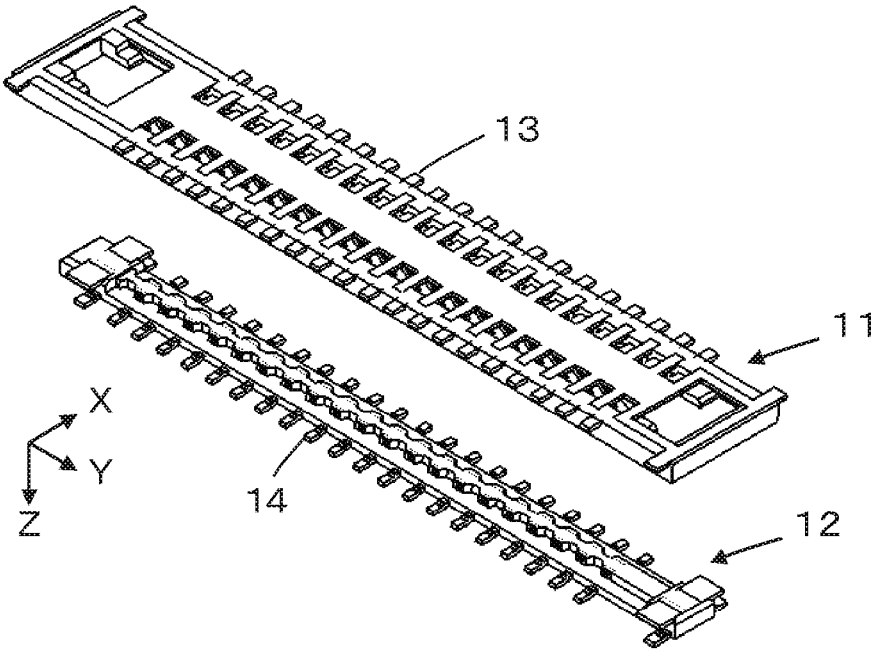
FIG. 2 is a perspective view of the receptacle and the plug of the thin connector, when viewed obliquely from below, according to Embodiment 1.
Figure 3A:
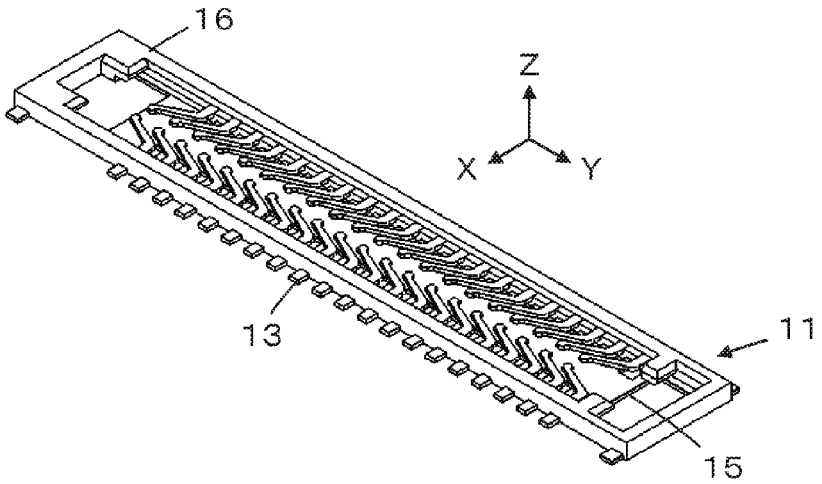
FIGS. 3A-3E are a perspective view when viewed obliquely from above, a plan view, a front view, a bottom view, and a side view, respectively, illustrating the receptacle used in the thin connector according, to Embodiment 1.
Figure 3B:
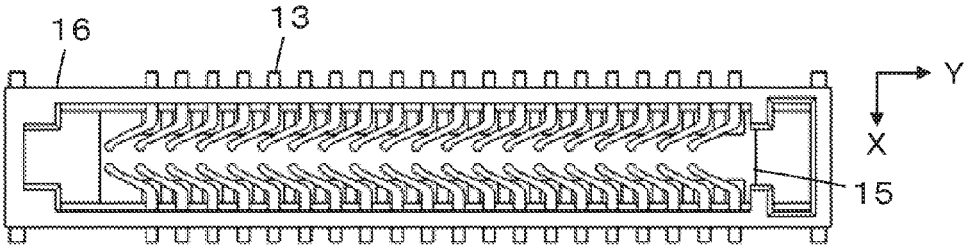
Figure 3C:
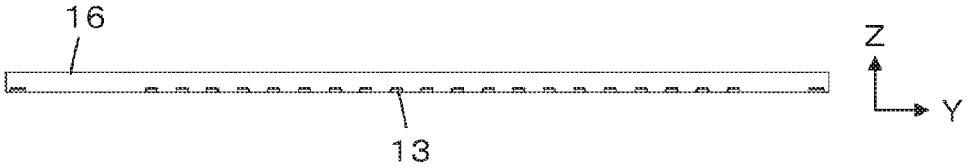
Figure 3D:
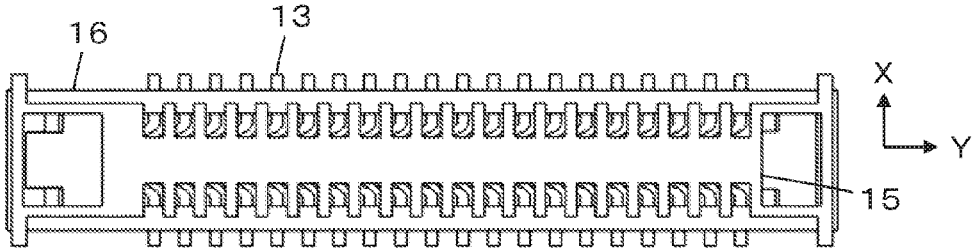
Figure 3E:
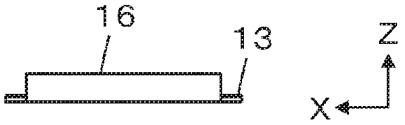

FIGS. 1 and 2 illustrate a configuration of a thin connector according to Embodiment 1 of the present invention. The thin connector comprises a flat plate receptacle (first connector) 11 and a flat plate plug (second connector) 12, and the receptacle 11 and the plug 12 are superimposed on each other to be fitted together. FIGS. 1 and 2 illustrate the receptacle 11 and the plug 12 that are placed in parallel and apart from each other, and FIG. 1 is a view when viewed obliquely from above while FIG. 2 is a view when viewed obliquely from below.

The receptacle 11 includes a plurality of receptacle contacts (first contacts) 13 arranged in two arrays, while the plug 12 includes a plurality of plug contacts (second contacts) 14 arranged in two arrays. The plurality of receptacle contacts 13 and the plurality of plug contacts 14 are both arranged at the same pitch P.

A plane along which the flat plate receptacle 11 and the flat plate plug 12 extend is assumed to be an XY plane, and a direction in which the plurality of receptacle contacts 13 and the plurality of plug contacts 14 are arranged is assumed to be a Y direction, whereas the plug 12 is assumed to be placed apart from the receptacle 11 in a Z direction.

As illustrated in FIGS. 3A to 3E, the receptacle 11 includes a laminate 15 in which a reinforcing plate made of stainless steel or the like and an insulating layer made of polyimide or the like are laminated, the plurality of receptacle contacts 13 arranged on the insulating layer in the laminate 15, and a receptacle insulator (first insulator) 16 that is insert-molded to have a frame shape so as to cover a part of each of the receptacle contacts 13 and a part of the laminate 15. The laminate 15 reinforces the receptacle 11 such that the receptacle 11 is not deformed by a force from the plug 12 at the time of fitting of the thin connector.

Figure 4:
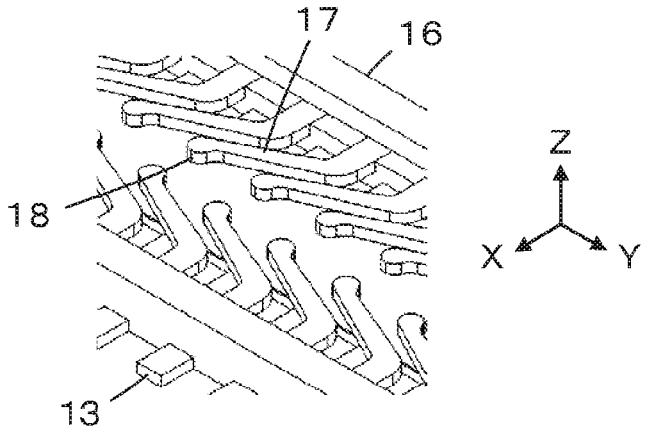
FIG. 4 is an enlarged partial perspective view illustrating a receptacle contact.

FIG. 4 illustrates that each of the receptacle contacts 13 has a spring portion 17 in a cantilever shape extending in a direction obliquely crossing the arrangement direction of the plurality of receptacle contacts 13 in the XY plane, particularly, in a direction inclined from the +X direction or the −X direction toward the −Y direction, inside the frame-shaped receptacle insulator 16. The spring portions 17 are arranged such that adjacent spring portions 17 partially overlap each other in the Y direction, and a rounded receptacle contact portion (first contact portion) 18 in a convex shape is formed at the tip end of each of the spring portions 17.

Figure 5:
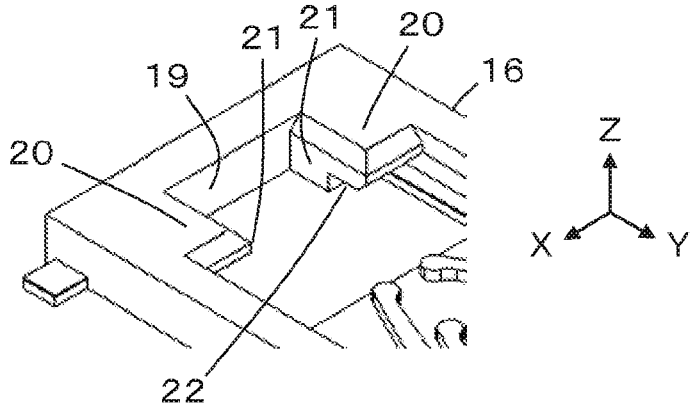
FIG. 5 is a perspective view illustrating one end of a receptacle insulator.

As illustrated in FIG. 5, in an end portion of the receptacle insulator 16 in the −Y direction, an end surface 19 facing the +Y direction is provided, and a pair of rectangular extending portions 20 are also provided at the end corners. The extending portions 20 form a pair of guide surfaces 21 opposing each other in the X direction, and each of the extending portions 20 is provided with a cutout 22 at its lower part.

Figure 6:
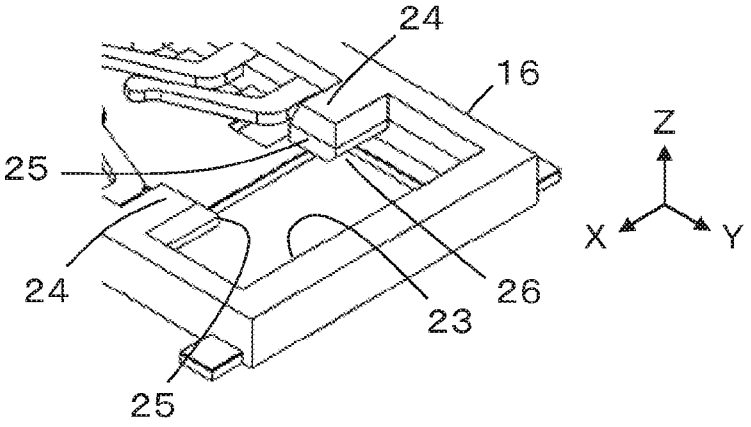
FIG. 6 is a perspective view illustrating the other end of the receptacle insulator.

In the meantime, as illustrated in FIG. 6, in the other end portion of the receptacle insulator 16 in the direction, an end surface 23 facing the −Y direction is provided, and a pair of rectangular extending portions 24 opposing each other in the X direction are also provided at the positions apart from the end surface 23 in the −Y direction by a predetermined distance. The extending portions 24 form a pair of guide surfaces 25 opposing each other in the X direction, while each of the extending portions 24 is formed to he thinner than the frame part of the receptacle insulator 16 and is provided with a cutout 26 at its lower part.

The end surfaces 19 and 23 as well as the guide surfaces 21 and 25 guide the plug 12 to slide inside the receptacle insulator 16, and the extending portions 20 and 24 as well as the cutouts 22 and 26 constitute first lock portions for maintaining the state of fitting between the receptacle 11 and the plug 12.

Figure 7:
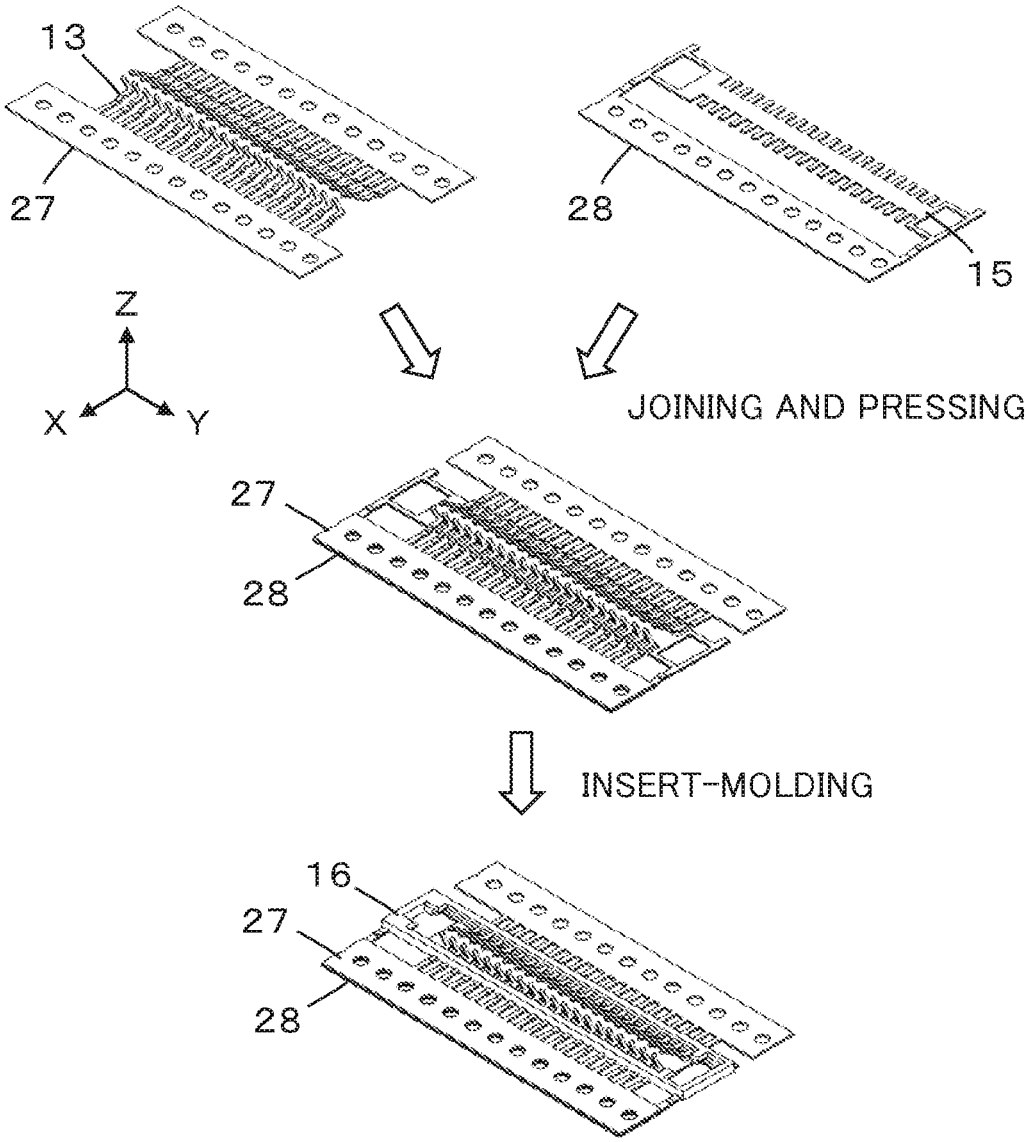
FIG. 7 is an assembly drawing of the receptacle.

As illustrated in FIG. 7, the receptacle 11 can be produced by attaching a conductive material 27 in which the plurality of receptacle contacts 13 are formed through punching in a pressing process to a composite material 28 comprising a reinforcing plate and an insulating layer which have been punched to have the shape of the laminate 15 through, for example, joining and pressing, followed by insert-molding the receptacle insulator 16 using a resin.

FIGS. 8A to 8E show that the plug 12 includes the plurality of plug contacts 14, a plug insulator (second insulator) 29 which is insert-molded so as to hold the plurality of plug contacts 14, and lock members 30 which are provided at both ends of the plug 12 in the Y direction and held by the plug insulator 29.

The plug insulator 29 has a substantially cuboid shape, is provided with an end surface 31 at the end in the −Y direction and is also provided with an end surface 32 at the other end in the +Y direction.

The plug insulator 29 has a projection portion 33 on a lower surface 29*a* facing the receptacle 11, the projection portion 33 projecting in the −Z direction and extending along the Y direction. The projection portion 33 is provided on its side surfaces with convex portions 34 and concave portions 35 alternately as illustrated in FIG. 9A, and a plug contact portion (second contact portion) 36 of each of the plug contacts 14 is formed to be exposed on the surface of each of the convex portions 34. The plug contact portion 36 is drawn out from the plug insulator 29 laterally in the +X direction or the −X direction as a plug contact draw-out portion 14*a* via a plug contact part buried inside the plug insulator 29. FIG. 9B shows that the plug contact portion 36 exposed on each of the convex portions 34 of the plug insulator 29 is provided with a concave notch 36*a* having a central depression. The lower surface 29*a* of the plug insulator 29 is present at the end of the notch 36*a* in the +Z direction, and an extending portion 29*b* of the plug insulator 29 extending over the notch 36*a* is present at the other end of the notch 36*a* in the −Z direction. In other words, the notch 36*a* has its both ends in the 3 direction closed by the plug insulator 29, being open only in the +X direction or −X direction.

The convex portions 34 and the concave portions 35 are both arranged in the Y direction at the arrangement pitch P same as that of the plug contacts 14, and a pair of neighboring convex portion 34 and concave portion 35 are apart from each other by a distance P/2 which is a half of the arrangement pitch P of the plug contacts 14.

Figure 10A:
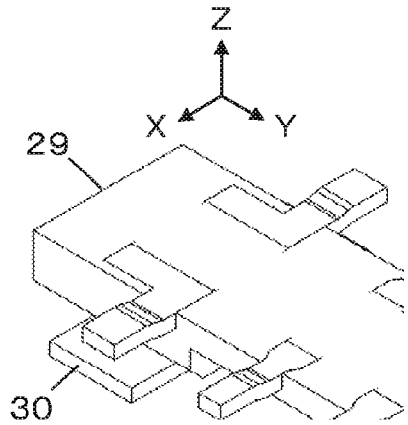
FIGS. 10A and 10B are a perspective view of an end of the plug when viewed obliquely from above and a perspective view of the end of the plug when viewed obliquely from below, respectively.
Figure 10B:
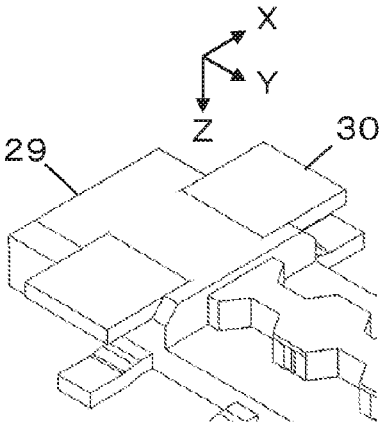

The lock members 30 constitute second lock portions and, as illustrated in FIGS. 10A and 10B, each of which has a flat plate shape protruding from the end portion of the plug insulator 29 in the +X direction and the −X direction.

Figure 11:
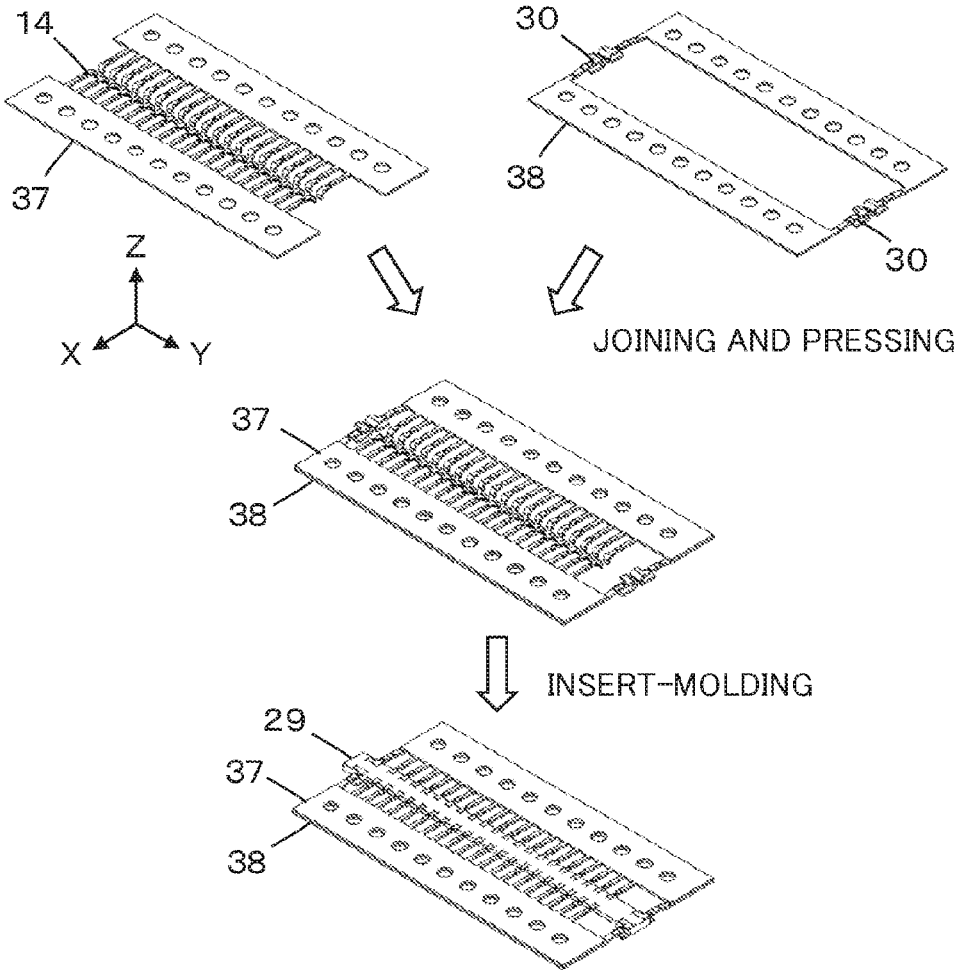
FIG. 11 is an assembly drawing of the plug.

As illustrated in FIG. 11, the plug 12 can be produced by attaching a conductive material 37 in which the plurality of plug contacts 14 are formed through punching and bending in a pressing process to a reinforcing plate 38 on which the lock members 30 are formed through, for example, joining and pressing, followed by insert-molding the plug insulator 29 using a resin.

The plug insulator 29 of the plug 12 is slidably accommodated in the frame-shaped receptacle insulator 16 of the receptacle 11. The length of the plug insulator 29 in the X direction substantially corresponds to the length of the inner periphery of the receptacle insulator 16 in the X direction, while the length of the plug insulator 29 in the Y direction is shorter than the length of the inner periphery of the receptacle insulator 16 in the Y direction by the distance P/2 which is a half of the arrangement pitch P of the receptacle contacts 13 and the plug contacts 14.

Next, the behavior of the thin connector when fitting according to Embodiment 1 will be described below. The plug insulator 29 of the plug 12 is inserted inside the frame-shaped receptacle insulator 16 of the receptacle 11 with the projection portion 33 facing downward, whereby the receptacle 11 and the plug 12 are superimposed on each other. At this time, the upper plane inside the frame of the receptacle insulator 16 of the receptacle 11 and the lower surface of the plug insulator 29 together form a fitting plane of the thin connector, and the side surfaces of the plug insulator 29 in a substantially cuboid shape are guided by the guide surfaces 21 and 25 of the receptacle insulator 16, whereby the plug 12 is disposed inside the receptacle insulator 16 of the receptacle 11 such that the plug 12 can slide in the Y direction relatively to the receptacle 11 within the fitting plane.

Figure 12:
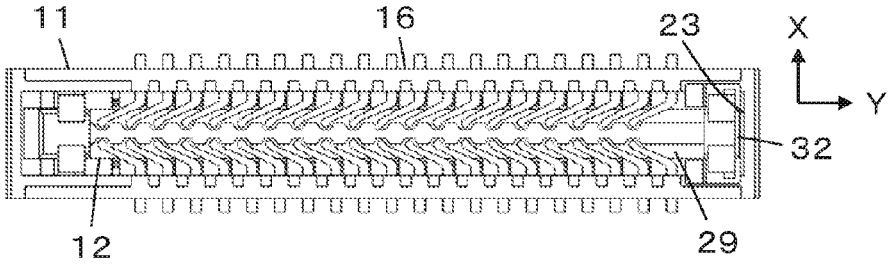
FIG. 12 is a bottom view of the thin connector before fitting, when viewed from below (parts unnecessary for explanation are omitted to clearly show the contact portions), according to Embodiment 1.
Figure 13A:
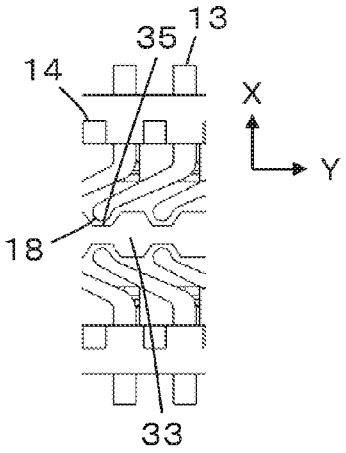
FIGS. 13A and 13B are an enlarged partial bottom view and an enlarged partial perspective view, respectively, illustrating the positional relation between the receptacle contacts and the plug contacts before fitting (parts unnecessary for explanation are omitted to clearly show the contact portions).
Figure 13B:
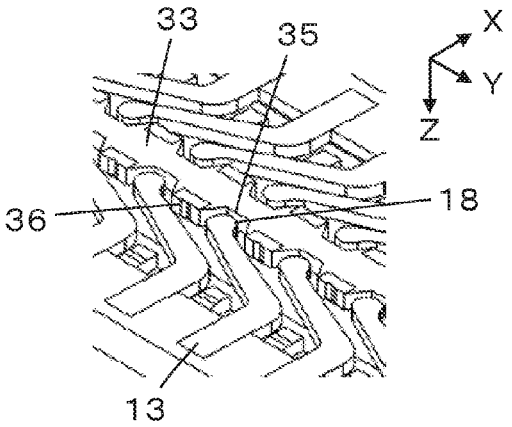

FIGS. 12, 13A and 13B illustrate the thin connector viewed from below, from which the laminate 15 is removed from the bottom part of the receptacle 11 so as to clearly show the positional relation between the receptacle contacts 13 and the plug contacts 14.

As illustrated in FIG. 12, when the plug 12 is located inside the receptacle insulator 16 to be closed to the end portion in the +Y direction and the end surface 32 of the plug insulator 29 in the +Y direction is in contact with the end surface 23 of the receptacle insulator 16, the plurality of concave portions 35 formed on the side surfaces of the projection portion 33 of the plug insulator 29 face the receptacle contact portions 18 at the tip ends of the corresponding receptacle contacts 13 of the receptacle 11 as illustrated in FIGS. 13A and 13B. Accordingly, the receptacle contact portions 18 of the receptacle contacts 13 are apart from the plug contact portions 36 of the plug contacts 14, whereby the plurality of plug contacts 14 of the plug 12 are in the non-conductive state with the corresponding receptacle contacts 13 of the receptacle 11.

Figure 14A:
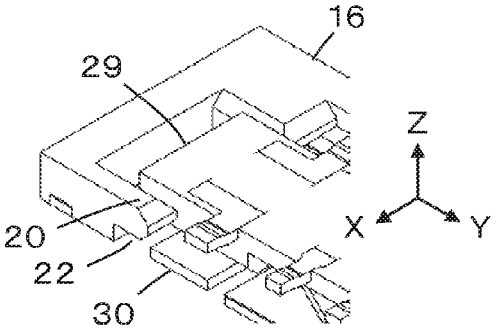
FIGS. 14A and 14B are an enlarged partial perspective view and an enlarged partial front view, respectively, illustrating the positional relation between the receptacle insulator and a plug insulator before fitting.
Figure 14B:
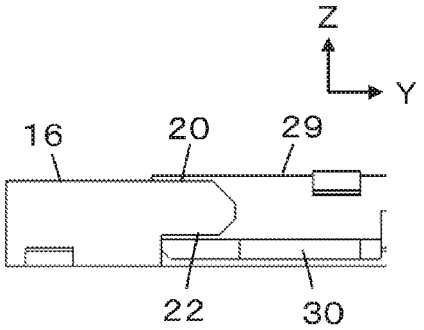

In this state, as illustrated in FIGS. 14A and 14B, the lock members 30 at the end of the plug 12 in the −Y direction are not inserted in the cutout portions 22 formed under the extending portions 20 of the receptacle insulator 16. In addition, although not shown in the drawings, the lock members 30 at the other end of the plug 12 in the +Y direction are also not inserted in the cutout portions 26 formed under the extending portions 24 of the receptacle insulator 160 Accordingly, the plug 12 is not caught by the receptacle 11 and is capable of moving vertically, i.e., in the Z direction.

Figure 15:
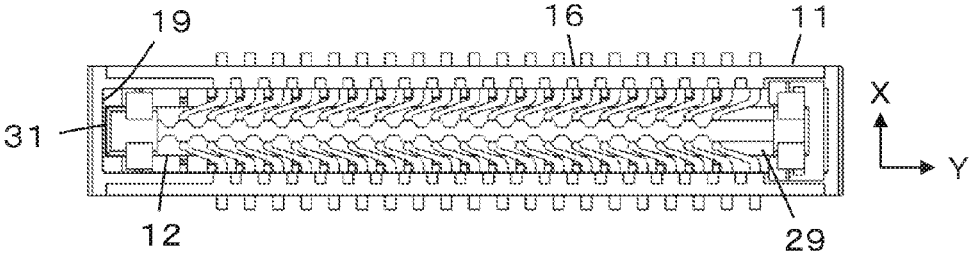
FIG. 15 is a bottom view of the thin connector after fitting from which the bottom part of the receptacle is removed, when viewed from below, according to Embodiment 1.
Figure 16A:
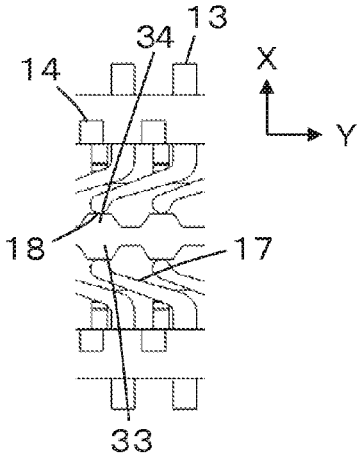
FIGS. 16A and 16B are an enlarged partial bottom view and an enlarged partial perspective view, respectively, illustrating the positional relation between the receptacle contacts and the plug contacts after fitting (parts unnecessary for explanation are omitted to clearly show the contact portions).
Figure 16B:
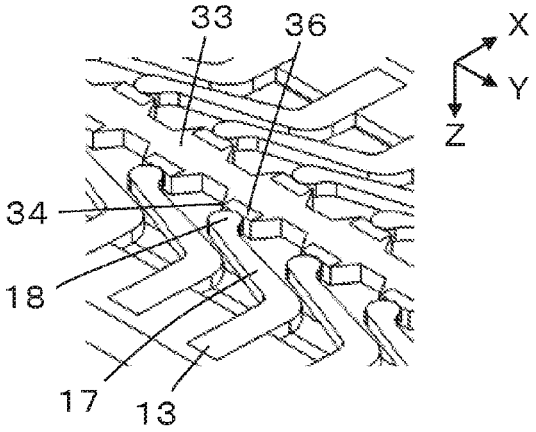

By sliding the plug 12 relatively to the receptacle 11 in the −Y direction merely by the distance P/2 which is a half of the arrangement pitch P of the receptacle contacts 13 and the plug contacts 14 until the end surface 31 of the plug insulator 29 in the −Y direction comes into contact with the end surface 19 of the receptacle insulator 16 as illustrated in FIG. 15, the plurality of convex portions 34 formed on the side surfaces of the projection portion 33 of the plug insulator 29 come to positions to face the receptacle contact portions 18 at the tip ends of the corresponding receptacle contacts 13 of the receptacle 11, as illustrated in FIGS. 16A and 16B. Therefore, the spring portions 17 of the receptacle contacts 13 are pushed by the concave portions 34 of the plug insulator 29 to elastically deform, and the receptacle contact portions 18 come into contact with the plug contact portions 36 of the plug contacts 14 at a predetermined contact force owing to the elastic force of the spring portions 17. In this manner, the plurality of plug contacts 14 of the plug 12 are electrically connected with the corresponding receptacle contacts 13 of the receptacle 11, while the receptacle 11 and the plug 12 are fitted with each other. Here, FIGS. 15, 16A and 16B as well as FIGS. 12, 13A and 13B are views showing the thin connector, from which the laminate 15 is removed from the bottom part of the receptacle 11, when viewed from below.

As illustrated in FIGS. 9A and 9B, as each of the plug contact portions 36 of the plug contacts 14 provided with a notch 36*a* having a central depression, each of the receptacle contact portions 18 in a rounded projecting shape falls into the notch 36*a* of the corresponding plug contact portion 36. Since both ends of each of the notches 36*a* in the Z direction are closed by the lower surface 29*a* and the extending portion 29*b* of the plug insulator 29, the receptacle contact portions 18 are engaged with the notches 36*a* of the plug contact portions 36 in such a manner that the receptacle contact portions 18 are locked in the Z direction without coming off from the notches 36*a* in the Z direction, whereby the contact between the receptacle contact portions 18 and the plug contact portions 36 is maintained.

Figure 17A:
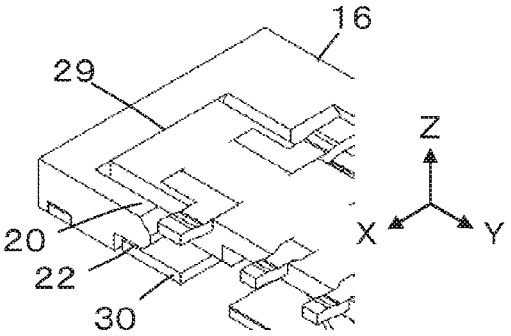
FIGS. 17A and 17B are an enlarged partial perspective view and an enlarged partial front view, respectively, illustrating the positional relation between the receptacle insulator and the plug insulator after fitting.
Figure 17B:
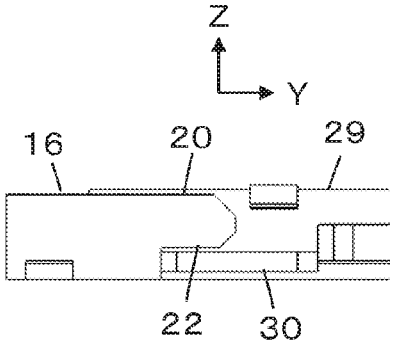

At this time, as illustrated in FIGS. 17A and 17B, the lock members 30 at the end of the plug 12 in the −Y direction are inserted into the cutout portions 22 of the extending portions 20 of the receptacle insulator 16, and, although not shown in the drawings, the lock members 30 at the other end of the plug 12 in the +Y direction are also inserted into the cutout portions 26 of the extending portions 24 of the receptacle insulator 16. In this manner, the plug 12 is in the state of being locked by the receptacle 11 without coming of from the receptacle 11 in the vertical direction, i.e., the Z direction.

Accordingly, as a result of fitting the receptacle 11 with the plug 12, the plurality of plug contacts 14 of the plug 12 are electrically connected with the corresponding receptacle contacts 13 of the receptacle 11 at a time.

In the thin connector according to Embodiment 1, each of the receptacle contacts 13 has the spring portion 17 extending diagonally with respect to the Y direction in which the receptacle contacts 13 are arranged and is provided with the receptacle contact portion 18 at the tip end of the spring portion 17, and by sliding the plug 12 relatively to the receptacle 11 in the arrangement direction of the receptacle contacts 13 and the plug contacts 14, the receptacle 11 and the plug 12 are fitted with each other. Hence, need for a space to allow the receptacle 11 and the plug 12 to slide relatively in the X direction orthogonal to the arrangement direction of the receptacle contacts 13 and the plug contacts 14 is eliminated, and the length of the thin connector in the X direction can be reduced.

In addition, as illustrated in FIGS. 3A to 3E and 4, since the spring portions 17 of the receptacle contacts 13 extend in a direction inclined to the Y direction and are arranged such that adjacent spring portions 17 partially overlap each other in the Y direction, the arrangement pitch P of the receptacle contacts 13 can be smaller than the length of the spring portion 17 and thus can be further narrowed.

In the above-described Embodiment A, the convex receptacle contact portions 18 respectively fall into the concave notches 36*a* of the plug contact portions 36, contact between the receptacle contact portions 18 and the plug contact portions 36 is maintained. Contrarily, however, by forming the concave notches in the receptacle contact portions 18 and also forming the plug contact portions 36 in a convex shape, the contact between the receptacle contact portions 18 and the plug contact portions 36 can be similarly maintained.

Embodiment 2

Figure 18:
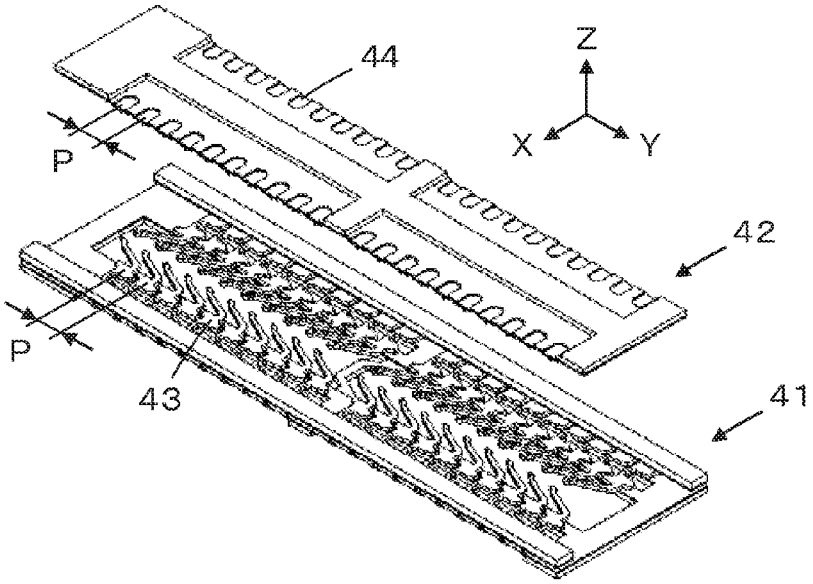
FIG. 18 is a perspective view of a receptacle and a plug of a thin connector, when viewed obliquely from above, according to Embodiment 2 of the present invention.
Figure 19:
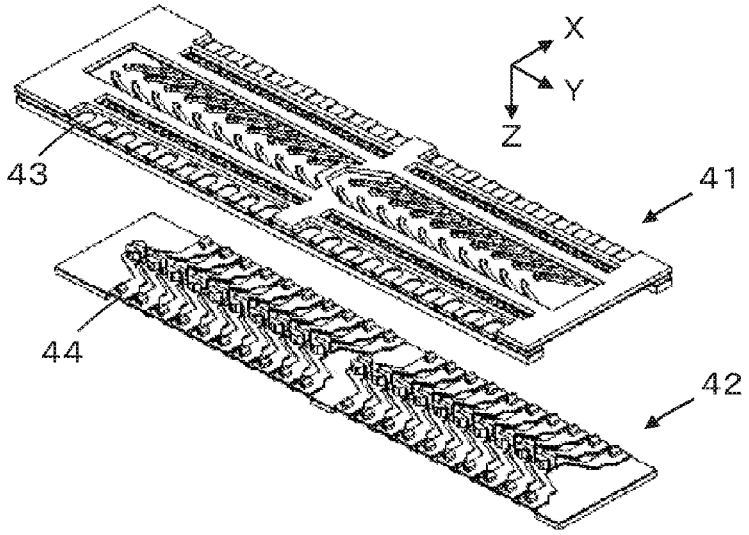
FIG. 19 is a perspective view of the receptacle and the plug of the thin connector, when viewed obliquely from below, according to Embodiment 2.

FIGS. 18 and 19 illustrate a configuration of a thin connector according to Embodiment 2 of the present invention. The thin connector comprises a flat plate receptacle (first connector) 41 and a flat plate plug (second connector) 42, and the receptacle 41 and the plug 42 are superimposed on each other to be fitted together. FIGS. 18 and 19 illustrate the receptacle 41 and the plug 42 that are placed in parallel and apart from each other, and FIG. 18 is a view when viewed obliquely from above while FIG. 19 is a view when viewed obliquely from below.

The receptacle 41 includes a plurality of receptacle contacts (first contacts) 43 arranged in two arrays, while the plug 42 includes a plurality of plug contacts (second contacts) 44 arranged in two arrays. The plurality of receptacle contacts 43 and the plurality of plug contacts 44 are both arranged at the same pitch P.

In this regard, a plane along which the flat plate receptacle 41 and the flat plate plug 42 extend is assumed to he an XY plane, and a direction in which the plurality of receptacle contacts 43 and the plurality of plug contacts 44 are arranged is assumed to he a Y direction, while the plug 42 assumed to be placed apart from the receptacle 41 in a Z direction.

As illustrated in FIGS. 20A to 20D and FIG. 21, the receptacle 41 is produced by using a laminate 48 having a three-layer structure in which a reinforcing plate 45 made of stainless steel or the like, an insulating layer 46 made of polyimide or the like, and a conductive material 47 made of copper or the like are sequentially laminated, and further a pair of frame bodies 51 both extending in the direction are provided on an edge portion of the upper surface of the laminate 48 on the +X direction side and on another edge portion of the upper surface of the laminate 48 on the −X direction side, respectively. Each of the frame bodies 51 is formed of a laminate of an insulating layer 49 and a reinforcing plate 50.

The frame bodies 51 guide the plug 42 such that the plug 42 can slide in the Y direction, and the pair of frame bodies 51 are apart from each other by a distance substantially corresponding to the length of the plug 42 in the X direction.

The reinforcing plate 45 and the insulating layer 46 of the laminate 48 are provided with an opening portion 52 extending in the Y direction at the central portion of the laminate 48. The plurality of receptacle contacts 43 are formed by patterning the conductive material 47, and a base end of each of the receptacle contacts 43 is held on the reinforcing plate 45 and the insulating layer 46, whereas a tip end thereof extends in the direction obliquely crossing the arrangement direction of the plurality of receptacle contacts 43 in the XY plane, in particular, in the direction inclined from the +X direction or the −X direction toward the −Y direction, thereby forming a spring portion 53 having a cantilever shape inside the opening portion 52. The spring portion 53 is provided with a receptacle contact portion (first contact portion) 54 at its tip end.

Each of the receptacle contacts 43 has at the base end thereof a deformation-suppression concave portion 55 in a cutout-like shape formed so as to open toward the +Y direction. Opening portions 56 are provided in the reinforcing plate 45 and the insulating layer 46 at the regions where the deformation-suppression concave portions 55 are located, the deformation-suppression concave portions 55 are exposed downward to the outside through the opening portions 56.

Further, the reinforcing plate 45 and the insulating layer 46 of the laminate 48 are provided at the midpoint in the Y direction with a connecting portion 57 crossing the opening portion 52 in the X direction to thereby connect the +X direction side and the −X direction side. The connecting portion 57 prevents the receptacle 41 from deforming in response to the force applied from the plug 42 during fitting the receptacle 41 and the plug 42 together.

The receptacle 41 can be produced by forming the opening portions 52 and 56 in the reinforcing plate 45 and the insulating layer 46 of the laminate 48 having a flat plate shape through etching and also subjecting the conductive material 47 to etching to thereby form the plurality of receptacle contacts 43 each of which has the spring portion 53 and the deformation-suppression concave portion 55, followed by attaching the pair of frame bodies 51 composed of the insulating layer 49 and the reinforcing plate 50 onto the upper surface of the laminate 48.

As illustrated in FIGS. 22A to 22D and FIG. 23, the plug 42 is produced by using a laminate 61 having a three-layer structure in which a reinforcing plate 58 made of stainless steel or the like, an insulating layer 59 made of polyimide or the like, and a conductive material 60 made of copper or the like are sequentially laminated.

A plurality of plug contacts 44 are formed by patterning the conductive material 60 inside the XY plane. Each of the plug contacts 44 extends in the direction inclined from the +X direction or the −X direction toward the −Y direction within the XY plane similarly to the receptacle contacts 43, and is provided at the tip end thereof with a projection portion 62 formed so as to protrude in the −Z direction perpendicular to the XY plane, while the side surface of the projection potion 62 constitutes a plug contact portion (second contact portion) 63. Each of the plug contacts 44 has at the base end thereof a deformation-suppression convex portion 64 protruding in the −Z direction perpendicular to the XY plane. The deformation-suppression convex portions 64 are respectively inserted into the deformation-suppression concave portions 55 of the corresponding receptacle contacts 43 when the plug 42 and the receptacle 41 are fitted together, thereby preventing the receptacle 41 from deforming.

The plug 42 can be produced by etching the conductive material 60 in the laminate 61 having a flat plate shape to form the planar parts of the plurality of plug contacts 44, followed by performing, for example, additive plating to thereby form the projection portions 62 at the tip ends of the plug contacts 44 and the deformation-suppression convex portions 64 at the base ends of the plug contacts 44, respectively.

Next, the behavior of the thin connector when fitting according to Embodiment 2 will be described below. The plug 42 having the conductive material 60 face downward is superimposed on the conductive material 47 between the pair of frame bodies 51 of the receptacle 41. At this time, the upper surface of the conductive material 47 of the receptacle 41 and the lower surface of the conductive material 60 of the plug 42 together form the fitting plane of the thin connector, and the plug 42 is disposed between the pair of frame bodies 51 of the receptacle 41 such that the plug 42 can slide relatively to the receptacle 41 in the Y direction within the fitting plane.

Figure 24:
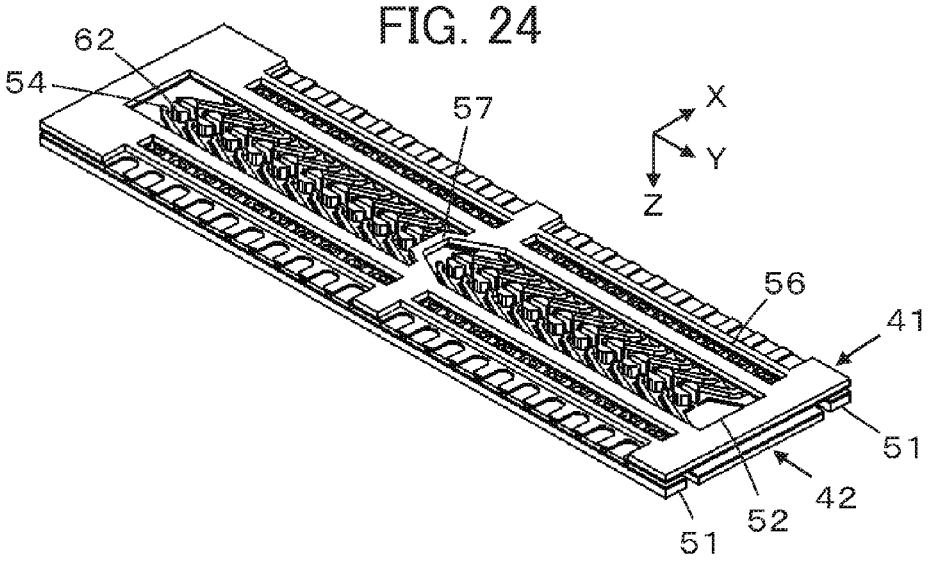
FIG. 24 is a perspective view of the thin connector before fitting, when viewed obliquely from below, according to Embodiment 2.
Figure 25:
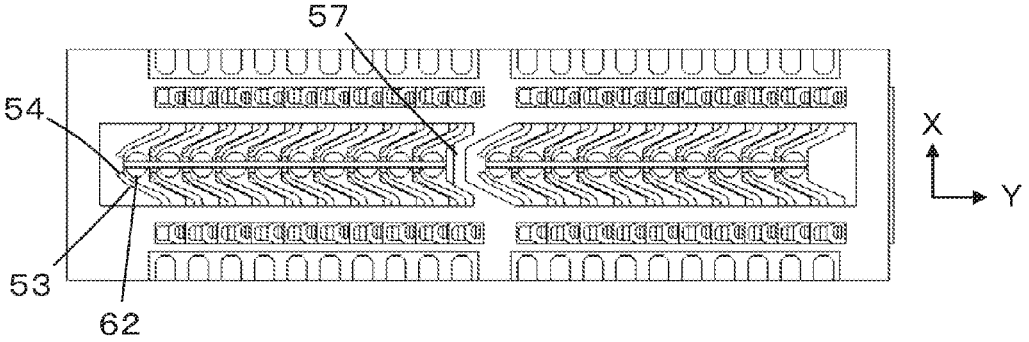
FIG. 25 is a bottom view of the thin connector before fitting according to Embodiment 2.

FIGS. 24 and 25 respectively are a perspective view when viewed obliquely from below and a bottom view both showing the thin connector for easy observation of the positional relation between the receptacle contacts 43 and the plug contacts 44 when the end portion of the plug 42 in the +Y direction is located at substantially same position as the end portion of the receptacle 41 in the +Y direction.

Figure 26:
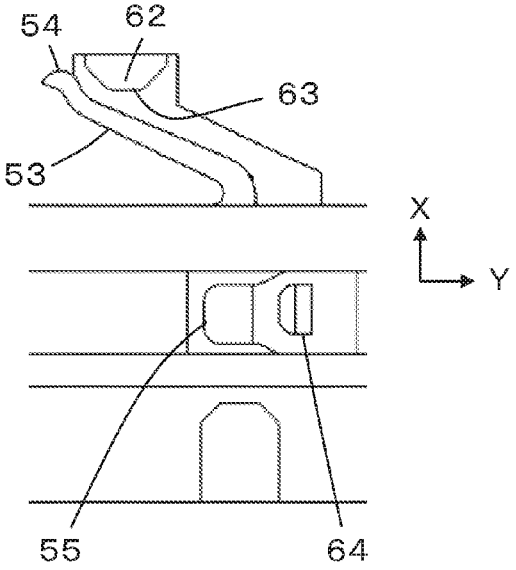
FIG. 26 is an enlarged partial bottom view illustrating the positional relation between a receptacle contact and a plug contact before fitting.

In this state, each of the plurality of projection portions 62 of the plugs 42 is located between adjacent receptacle contact portions 54 of the receptacle 41 in the XY plane and is apart from the receptacle contact portion 54 of the corresponding receptacle contact 43, as illustrated in FIG. 26, whereby the receptacle contact portion 54 of each of the receptacle contacts 43 and the plug contact portion 63 of each of the plug contacts 44 are apart from each other.

FIG. 26 is also a view of the thin connector viewed from below like FIGS. 24 and 25, and at this time, the deformation-suppression convex portions 64 formed at the base ends of the plug contact 44, respectively, are not yet inserted into the deformation-suppression concave portions 55 of the receptacle contacts 43.

Figure 27:
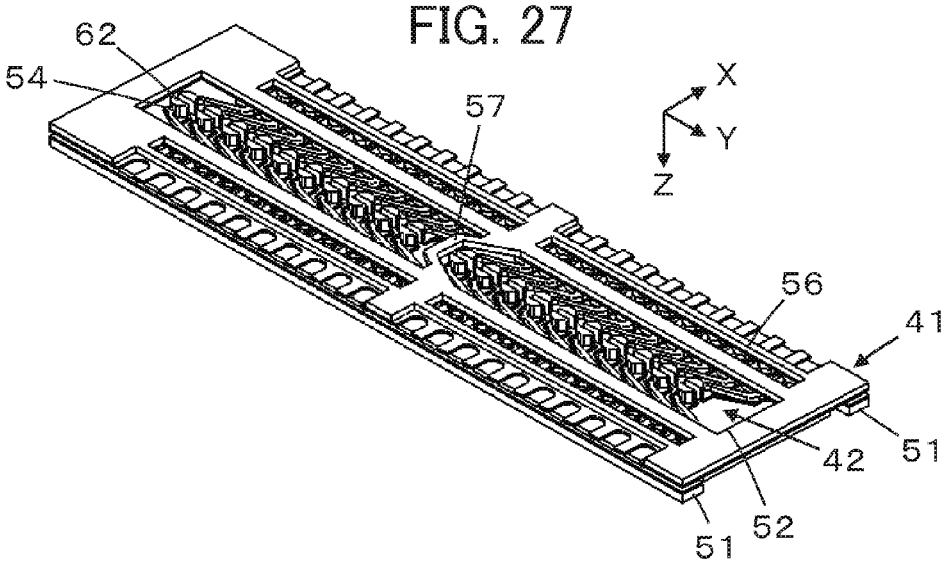
FIG. 27 is a perspective view of the thin connector after fitting, when viewed obliquely from below, according to Embodiment 2.
Figure 28:
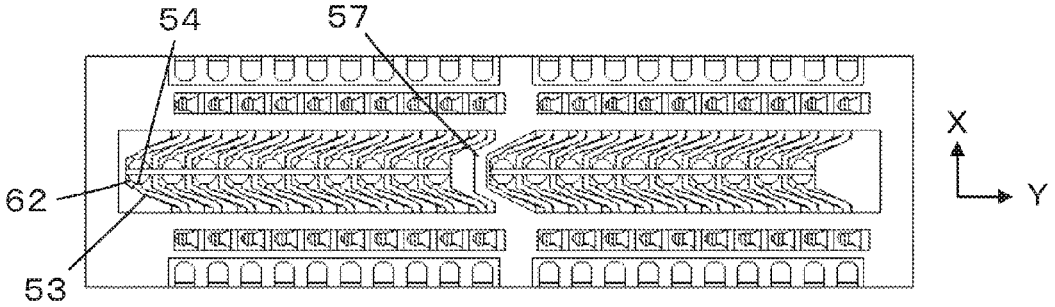
FIG. 28 is a bottom view illustrating the thin connector after fitting according to Embodiment 2.
Figure 29:
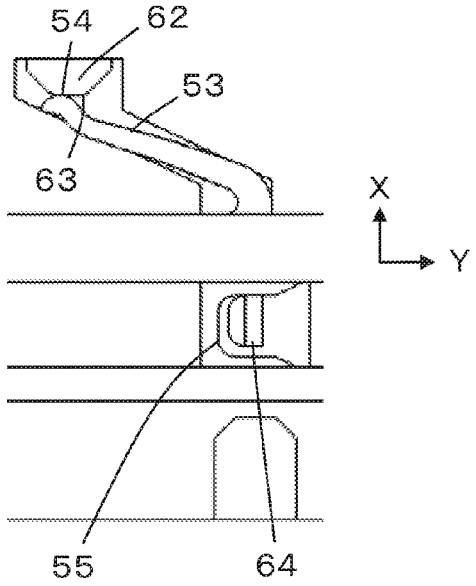
FIG. 29 is an enlarged partial bottom view illustrating the positional relation between a receptacle contact and a plug contact after fitting.

By sliding the plug 42 relatively to the receptacle 41 in the −Y direction by the distance of P/2 which is a half of the arrangement pitch P of the receptacle contacts 43 and the plug contacts 44, as illustrated in FIGS. 27 and 28, the projection portion 62 of each of the plug contacts 44 comes in the position to face the receptacle contact portion 54 of the corresponding receptacle contact 43 of the receptacle 41 in the XY plane. Accordingly, as illustrated in FIG. 29, the spring portion 53 of each of the receptacle contacts 43 is pushed by the projection portion 62 of the corresponding plug contact 44 to elastically deform, whereby the receptacle contact portion 54 formed at the tip end of the spring portion 53 comes into contact with the plug contact portion 63 formed on the side surface of the projection portion 62 at a predetermined contact force owing to the elastic force of the spring portion 53. In this manner, the plurality of plug contacts 44 of the plug 42 are electrically connected with the corresponding receptacle contacts 43 of the receptacle 41, while the receptacle 41 and the plug 42 are fitted with each other. FIGS. 27 to 29 are also views of the thin connector viewed from below like FIGS. 24 to 26.

Accordingly, as a result of fitting the receptacle 41 with the plug 42, the plurality of plug contacts 44 of the plug 42 are electrically connected with the corresponding receptacle contacts 43 of the receptacle 41 at a time.

At this time, as illustrated in FIG. 29, the deformation-suppression convex portions 64 formed at the base ends of the plug contacts 44 are inserted into the deformation-suppression concave portions 55 formed at the base ends of the corresponding receptacle contacts 43, respectively. Hence, deformation of the receptacle 41 can be suppressed even if the receptacle 41 is applied with a certain contact force by the spring portions 53 of the receptacle contacts 43.

Similarly to the thin connector according to Embodiment 1, also in the thin connector according to Embodiment 2, the receptacle contacts 43 have the spring portions 53 extending diagonally with respect to the Y direction in which the receptacle contacts 43 are arranged while the receptacle contact portion 54 is formed at the tip end of each of the spring portions 53, and the receptacle 41 and the plug 42 are fitted with each other by sliding the plug 42 relatively to the receptacle 41 in the arrangement direction of the receptacle contacts 43 and the plug contacts 44. Hence, need for a space to allow the receptacle 41 and the plug 42 to relatively slide in the X direction orthogonal to the arrangement direction of the receptacle contacts 43 and the plug contacts 44 is eliminated, and the length of the thin connector in the X direction can be reduced.

Figure 20A:
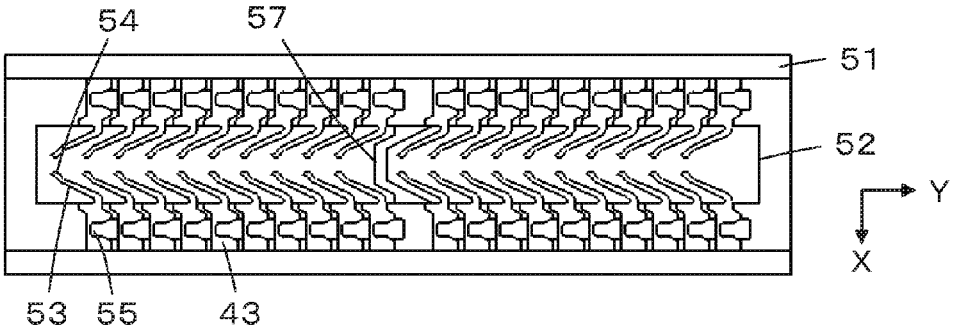
FIGS. 20A-20D are a plan view, a front view, a bottom view and a side view, respectively, illustrating the receptacle used in the thin connector according to Embodiment 2.
Figure 20B:
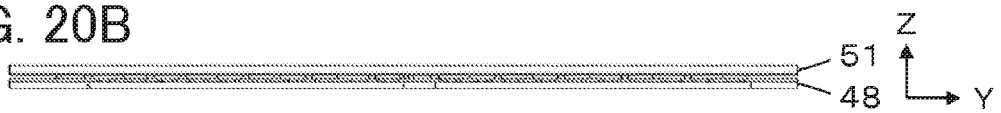
Figure 20C:
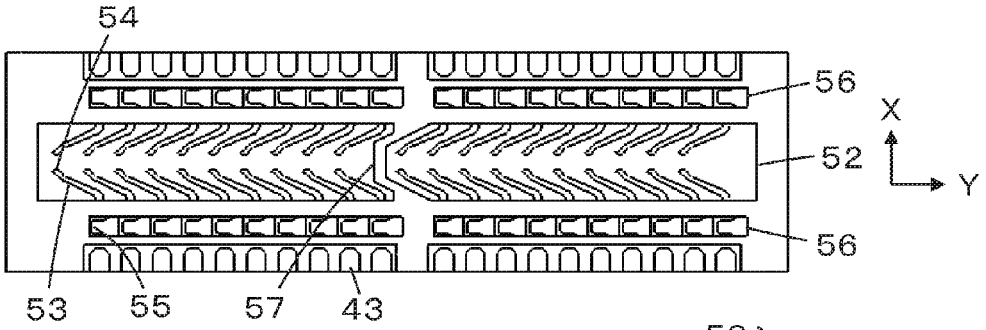
Figure 20D:
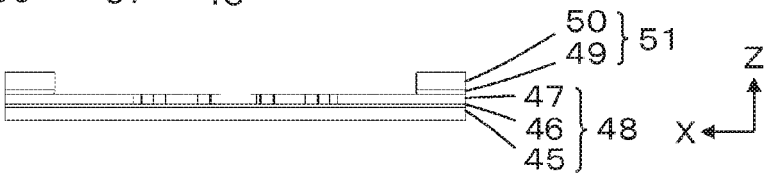
Figure 21:
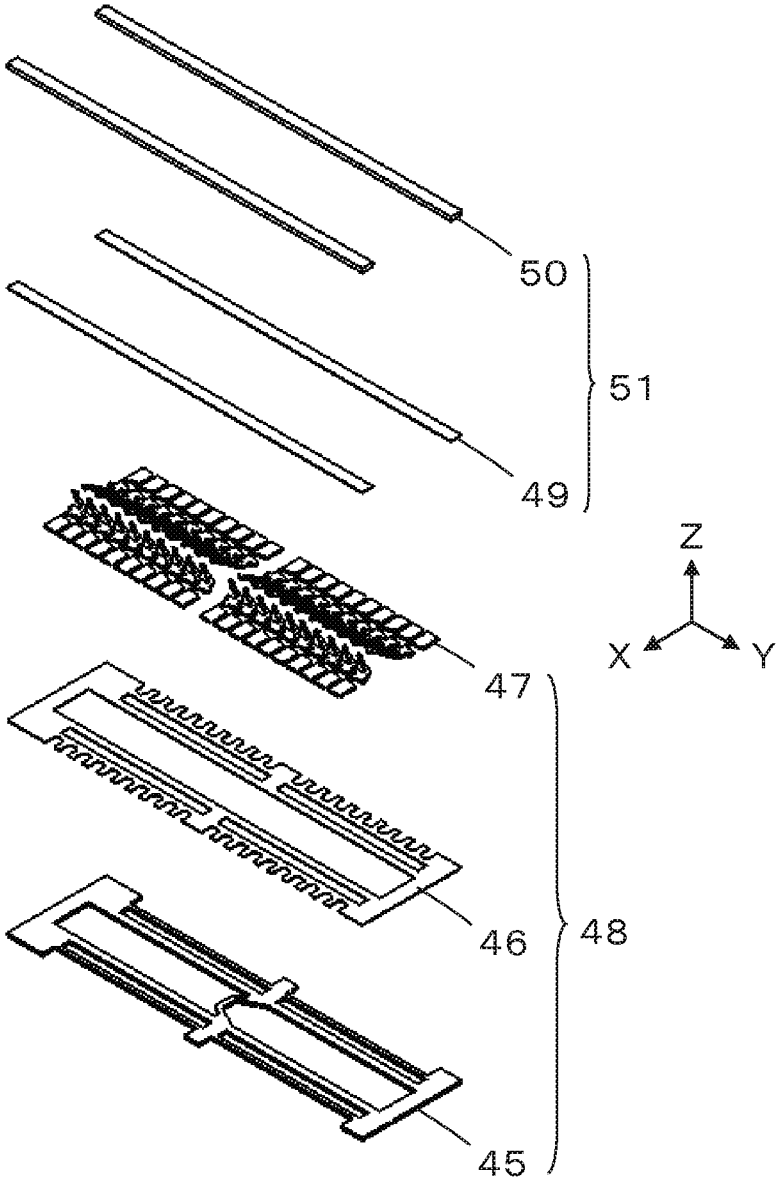
FIG. 21 is an exploded view of the receptacle.
Figure 22A:
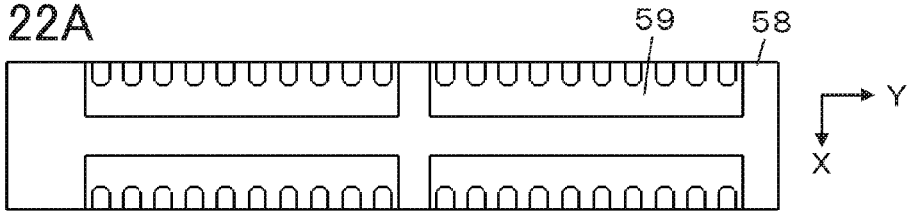
FIGS. 22A-22D are a plan view, a front view, a bottom view and a side view, respectively, illustrating the plug used in the thin connector according to Embodiment 2.
Figure 22B:
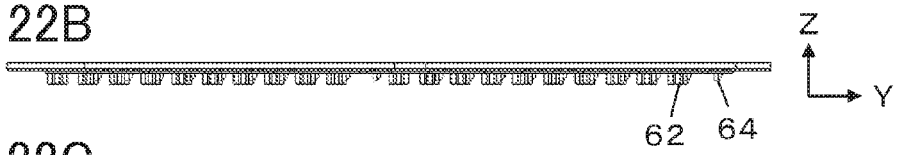
Figure 22C:
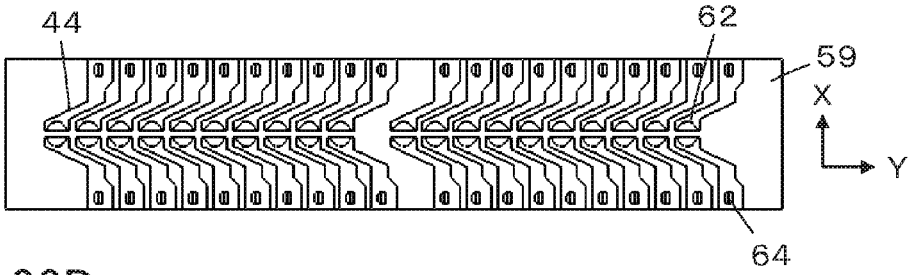
Figure 22D:
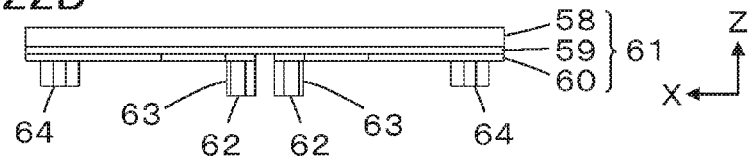
Figure 23:
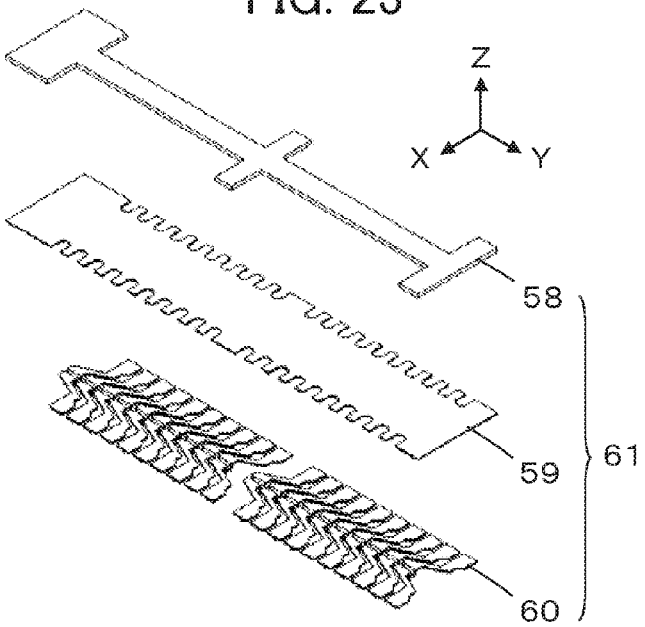
FIG. 23 is an exploded view of the plug.

In addition, as illustrated in FIGS. 20A and 20C, since the spring portions 53 of the receptacle contacts 43 extend in a direction inclined to the Y direction and are arranged such that adjacent spring portions 53 partially overlap each other in the Y direction, the arrangement pitch P of the receptacle contacts 43 can he smaller than the length of the spring portion 53 and thus can be further narrowed.

In the above-described Embodiment 2, the deformation-suppression convex portions 64 of the plug contacts 44 are respectively inserted into the deformation-suppression concave portions 55 in the receptacle contacts 43. Contrarily, however, by forming the deformation-suppression concave portions in the plug contacts 44 and also forming the deformation-suppression convex portions at the receptacle contacts 43, deformation of the receptacle 41 can be similarly suppressed.

Moreover, in the above-described Embodiment 2, the receptacle contacts 43 and planar parts of the plug contacts 44 are formed by etching the conductive materials 47 and 60 of the laminates 48 and 61, respectively. However, this is not the sole case, and the receptacle contacts 43 and the planar parts of the plug contacts 44 can be also formed by punching each of the conductive materials 47 and 60. For example, following formation of the opening portions 52 and 56 in the reinforcing plate 45 and the insulating layer 46 of the laminate 48 through etching, the conductive material 47 is subjected to punching to thereby form the receptacle contacts 43. The same applies to the planar parts of the plug contacts 44.

Normally, a contact shape can be produced at the higher precision by punching the conductive material through punching process rather than by etching. Hence, only a point-of-contact portion can be formed by punching, whereas the rest of the contact portion can be formed by etching.

Moreover, the receptacle contacts or the plug contacts can be formed not by using the three-layer laminates 48 and 61 but by performing electrolytic plating on the surface of an insulating layer of a two-layer laminate consisting of a reinforcing plate and the insulating layer.

Figure 30:
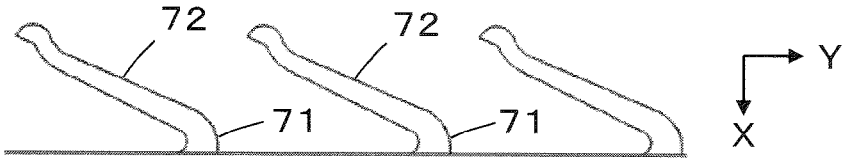
FIG. 30 is a plan view illustrating receptacle contacts used in a thin connector according to another embodiment.
Figure 31:
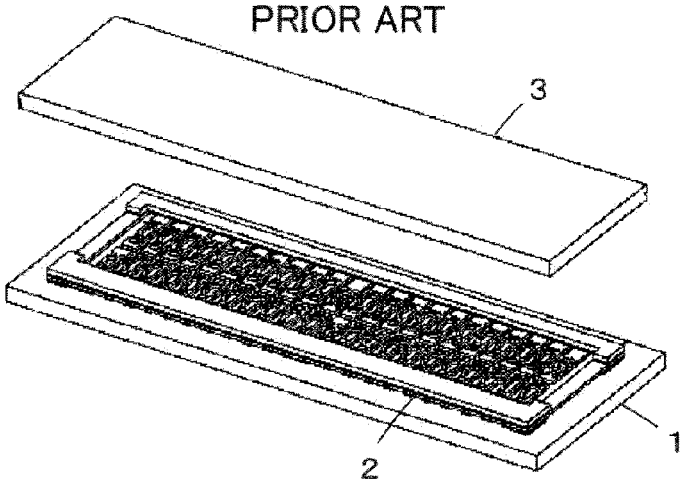
FIG. 31 PRIOR ART
FIG. 31 is a perspective view illustrating a configuration of a conventional connector.
Figure 32:
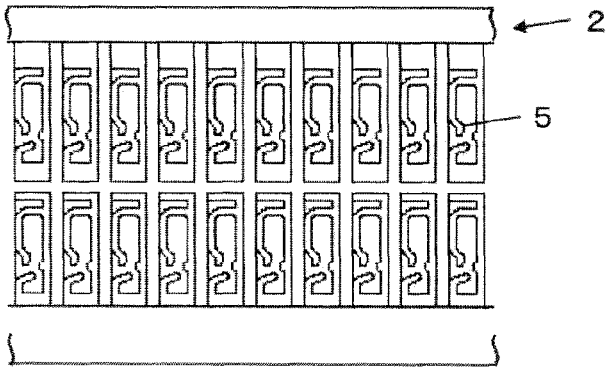
FIG. 32 PRIOR ART
FIG. 32 is a plan view illustrating a part of a receptacle used in the conventional connector.
Figure 33:
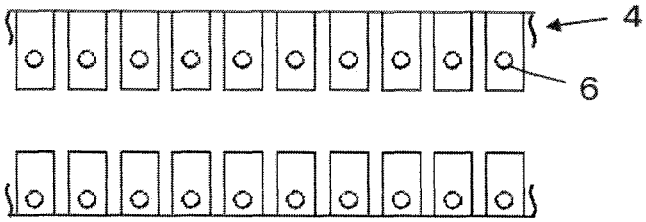
FIG. 33 PRIOR ART
FIG. 33 is a plan view illustrating a part of a plug used in the conventional connector.
Figure 34:
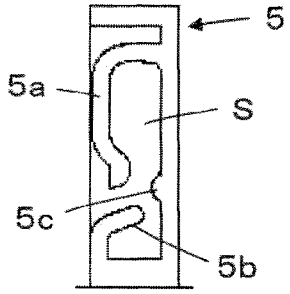
FIG. 34 PRIOR ART
FIG. 34 is an enlarged plan view illustrating a receptacle contact used in the conventional connector.
Figure 35:
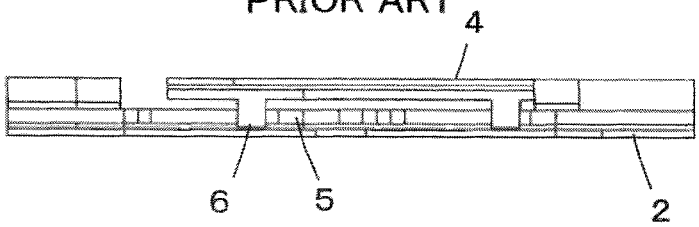
FIG. 35 PRIOR ART
FIG. 35 is a side view illustrating the conventional connector before fitting.
Figure 36:
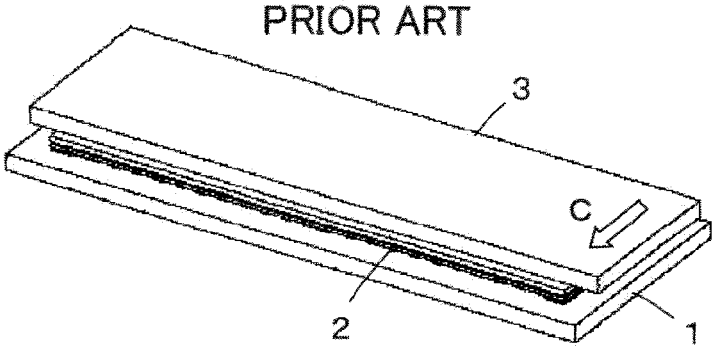
FIG. 36 PRIOR ART
FIG. 36 is a perspective view illustrating fitting behavior in the conventional connector.

In Embodiments 1 and 2 described above, the spring portions 17 and 53 of the receptacle contacts 13 and 43 are arranged such that adjacent spring portions 17 and 53 partially overlap each other in the Y direction. This is not however a sole case, and receptacle contacts 71 can be constituted in such a manner that adjacent spring portions 72 of the receptacle contacts 71 do not overlap each other in the Y direction as illustrated in FIG. 30. Nevertheless, it is advantageous to arrange the spring portions 17 and 53 such that the adjacent spring portions 17 and 53 partially overlap each other in the Y direction like in Embodiments 1 and 2 in terms of further narrowing the arrangement pitch.

In addition, in Embodiments 1 and 2, the receptacles 11 and 41 respectively include the plurality of receptacle contacts 13 and 43 arranged in two arrays, while the plugs 12 and 42 respectively include the plurality of plug contacts 14 and 44 arranged in two arrays. However, the plurality of receptacle contacts and the plurality of plug contacts can be arranged in a single array or in three or more arrays.

What is claimed is:

1. A thin connector comprising: a first connector having a flat plate shape and a second connector having a flat plate shape superimposed on and fitted with each other in a fitting plane, wherein the first connector includes a plurality of first contacts arrayed in a direction, each of the plurality of first contacts being provided with a first contact portion, wherein the second connector includes a plurality of second contacts arrayed in a same direction as the direction in which the plurality of first contacts are arrayed, each of the plurality of second contacts being provided with a second contact portion, wherein each of the plurality of first contacts has a spring portion which extends in a direction obliquely crossing the direction in which the plurality of first contacts are arrayed and on which the first contact portion is formed, and wherein the first connector and the second connector are superimposed on each other in the fitting plane and are slid relatively in the direction in which the plurality of first contacts and the plurality of second contacts are arrayed so that the second contact portion of each of the plurality of second contacts in the second connector comes in contact with the first contact portion of a corresponding first contact among the plurality, of first contacts in the first connector, whereby the first connector and the second connector are fitted with each other.

2. The thin connector according to claim 1, wherein the spring portion of each of the plurality of first contacts has a cantilever shape, and the first contact portion is formed at a tip end of the spring portion.

3. The thin connector according to claim 1, wherein the spring portion of each of the plurality of first contacts extends diagonally with respect to the direction in which the plurality of first contacts are arrayed and partially overlaps the spring portion of a neighboring first contact among the plurality of first contacts in the direction in which the plurality of first contacts are arrayed.

4. The thin connector according to claim 1, wherein the first connector and the second connector respectively have a first insulator and a second insulator which are formed of resin and respectively hold the plurality of first contacts and the plurality of second contacts.

5. The thin connector according to claim 4, wherein the plurality of first contacts and the plurality of second contacts are independently produced by performing pressing process on a conductive material.

6. The thin connector according to claim 4, wherein the plurality of first contacts are disposed on an insulating layer constituting, together with a reinforcing plate, a laminate and are held in this state by the first insulator.

7. The thin connector according to claim 4, wherein either one of the first contact portion of each of the plurality of first contacts and the second contact portion of each of the plurality of second contacts has a convex shape, whereas another one of the first contact portion and the second contact portion has a concave shape, and the first contact portion and the second contact portion are fitted with each other when the first connector and the second connector are fitted together.

8. The thin connector according to claim 7, wherein the other one of the first contact portion and the second contact portion having a concave shape is closed by the first insulator or the second insulator at both ends in a direction perpendicular to the first connector and the second connector both having a flat plate shape, and the one of the first contact portion and the second contact portion having a convex shape is fitted with the other one of the first contact portion and the second contact portion in a state of being locked in a direction perpendicular to the first connector and the second connector.

9. The thin connector according to claim 4, wherein the first connector and the second connector are respectively provided with first lock portions and second lock portions at both end portions of the first connector and the second connector in the direction in which the plurality of first contacts and the plurality of second contacts are arrayed, the first lock portions and the second lock portions maintaining a state of fitting between the first connector and the second connector.

10. The thin connector according to claim 1, wherein the plurality of first contacts and the plurality of second contacts are both produced by using a laminate in which a reinforcing plate, an insulating layer and a conductive material are sequentially laminated, and wherein the first contact portion and the second contact portion are independently produced by performing etching process or punching process on the conductive material.

11. The thin connector according to claim 1, wherein the plurality of first contacts and the plurality of second contacts are independently produced by performing electrolytic plating on an insulating layer of a laminate in which a reinforcing plate and the insulating layer are laminated.

12. The thin connector according to claim 10, wherein each of the plurality of second contacts has a projection portion protruding in a direction perpendicular to the fitting plane, and the second contact portion is formed on a side surface of the projection portion.

13. The thin connector according to claim 12, wherein the projection portion of each of the plurality of second contacts is formed by additive plating.

14. The thin connector according to claim 10, wherein either one of the plurality of first contacts and the plurality of second contacts have deformation-suppression convex portions while another one of the plurality of first contacts and the plurality of second contacts have deformation-suppression concave portions formed in the direction in which the plurality of first contacts and the plurality of second contacts are arrayed, and the deformation-suppression convex portions are inserted into the deformation-suppression concave portions, respectively, when the first connector and the second connector are fitted with each other.

* * * * *